US006578500B2

(12) United States Patent
Malizia

(10) Patent No.: US 6,578,500 B2
(45) Date of Patent: Jun. 17, 2003

(54) COLLAPSIBLE STRUCTURE

(75) Inventor: Mario Malizia, Castelfidardo (IT)

(73) Assignee: TAM SRL (IT)

( * ) Notice: Subject to any disclaimer, the term of this patent is extended or adjusted under 35 U.S.C. 154(b) by 0 days.

(21) Appl. No.: 09/967,394

(22) Filed: Sep. 26, 2001

(65) Prior Publication Data

US 2003/0056699 A1 Mar. 27, 2003

(51) Int. Cl.[7] ..... A47B 3/00
(52) U.S. Cl. ..... 108/115
(58) Field of Search ..... 108/115, 6; 297/335, 297/336; 248/277.1, 276.1

(56) References Cited

U.S. PATENT DOCUMENTS 189,222 A * 4/1877 Hook
348,706 A * 9/1886 Weiner
5,069,142 A * 12/1991 Matre
5,078,056 A * 1/1992 McCauley
5,622,119 A * 4/1997 Hsieh
5,771,815 A * 6/1998 Leftwich
6,019,050 A * 2/2000 Ranta

FOREIGN PATENT DOCUMENTS

DE 4015989 A1 * 11/1990

* cited by examiner

*Primary Examiner*—Jose V. Chen
(74) *Attorney, Agent, or Firm*—Amster, Rothstein & Ebenstein

(57) ABSTRACT

A collapsible structure includes first and second longitudinally extending rigid members, and a connector pivotally connecting the first and second members for movement between a compact storage orientation, wherein the first and second members extend longitudinally in a substantially parallel relationship, and an erected use orientation, wherein the first and second members extend longitudinally in a substantially non-parallel relationship. Movement between the storage and use orientations requires movement of the second member through an arc greater than 180° and less than 360° into a reflex angle relative to the first member.

18 Claims, 8 Drawing Sheets

COLLAPSIBLE STRUCTURE

BACKGROUND OF THE INVENTION

The present invention relates to a collapsible structure, such as a chair or stand, and more particularly to a collapsible structure characterized by a high level of stability and easily releaseable means for automatically locking it in the erected use orientation.

A wide variety of collapsible structures are well-known. Chairs and Z-stands are well-known examples in the furniture art. Such collapsible structures typically comprise first and second longitudinally extending rigid members, and means pivotally connecting the first and second members for movement between a compact storage orientation and an erected use orientation. In the compact storage orientation, the first and second members extend longitudinally in a substantially parallel relationship, both for ease of handling and for minimization of the storage space required. In the erected use orientation, the first and second members extend longitudinally in a substantially non-parallel relationship, so that the generally horizontal second member acts as a base or support for the generally vertical first member.

In some collapsible structures, there are first, second and third longitudinally extending rigid members. Adjacent one end of the first member (that is, the generally vertical member) first means are provided for pivotally connecting the first and second members for movement between a compact storage orientation and an erected use orientation. Adjacent the opposite end of the first member (that is, the generally vertical member) second means are provided for pivotally connecting the first and third members for movement between a compact storage orientation and an erected use orientation. In the compact storage orientation, the first, second and third members extend longitudinally in a substantially parallel relationship; and in the erected use orientation the second and third members extend longitudinally in a substantially non-parallel relationship with the first member, the second and third members typically extending longitudinally in a substantially parallel relationship with each other.

The known collapsible structures have not proven to be entirely satisfactory in use. First, in the erected use orientation the collapsible structures tend not to be as secure, reliable and rigid as counterpart non-collapsible structures. For example, a collapsible chair, typically has a different, often more wobbly, feel to a person sitting in the chair than a non-collapsible chair, and this difference can make the user feel somewhat insecure.

Second, typically the collapsible structure must be either automatically or manually locked into the erected use orientation. Manually locking of the collapsible structure is frequently awkward and time consuming. On the other hand, an automatic locking system must still be capable of manual release to permit subsequent movement of the structure into the compact storage orientation. However, commonly the manual release mechanism is either awkward and time-consuming to use or susceptible to being accidentally activated (for example, by the person sitting in the chair inadvertently activating the release mechanism) with unintended and potentially disastrous results.

Accordingly, it is an object of the present invention to provide a collapsible structure affording a very high degree of security when it is in the erected use orientation.

Another object is to provide such a structure which, in one preferred embodiment, automatically locks in the erected use orientation with the lock being protected against unintended release.

A further object is to provide such a collapsible structure which, in one preferred embodiment, combines a high level of security in the erected use orientation and protection against accidental release of the locking system.

It is also an object of the present invention to provide such a structure which is simple and inexpensive to construct, use and maintain.

SUMMARY OF THE INVENTION

It has now been found that the above and related objects of the present invention are obtained in a collapsible structure comprising first and second longitudinally extending rigid members and means pivotally connecting the first and second members for movement between a compact storage orientation, wherein said first and second members extend longitudinally in a substantially parallel relationship, and an erected use orientation, wherein said first and second members extend longitudinally in a substantially non-parallel relationship. Movement between the storage and use orientations requires movement of the second member through an arc greater than 180° and less than 360° into a reflex angle relative to the first member.

Preferably, the connecting means has one end thereof fixedly secured to the first member, extends transverse to the first member, and has an opposite end thereof pivotally secured to the second member. The connecting means limits movement of the second member through the arc beyond the reflex angle relative to the first member. The connecting means is configured and dimensioned to receive therein a full cross-section of the second member when the second member is at the reflex angle.

The present invention also encompasses a collapsible structure comprising first and second longitudinally extending rigid members, means pivotally connecting the first and second members for movement between a compact storage orientation wherein the first and second members extend longitudinally in a substantially parallel relationship and an erected use orientation where the first and second members extend longitudinally in a substantially non-parallel relationships. Locking means include a depressable locking button on the second member biased to extend outwardly therefrom, and an aperture in the first member configured and dimensioned to receive at least a portion of the button. A camming ledge extends outwardly from the first member and above the aperture both for automatically temporarily depressing the button as the second member moves from the storage orientation into the use orientation, and for limiting accidental depression of the button when the second member is in the use orientation and the button extends outwardly from the first member below the ledge, while still permitting intentional manual forcible depression of the button out of the aperture, thereby to enable movement of the second member from the use orientation to the storage orientation.

Preferably, the ledge extends outwardly from the first member at least as far as the portion of the button extending outwardly from the first member, is disposed closely adjacent the button portion, and extends upwardly and outwardly. The ledge may be a turned-out edge portion of the first member.

The present invention further encompasses a collapsible structure comprising first, second and third longitudinally extending rigid members. Adjacent one end of the first member, means pivotally connect the third and first members for movement between a compact storage orientation, wherein the third and first members extend longitudinally in a substantially parallel relationship, and an erected use orientation, wherein the third and first members extend longitudinally in a substantially non-parallel relationship. Movement between the storage and use orientations requires movement of the third member through an arc greater than 180° and less than 360°—preferably an arc of about 280°—into a reflex angle relative to the first member.

Preferably, the connecting means has one end thereof fixedly secured to the first member, extends transverse to the first member in an opposed second direction, and has an opposite end thereof pivotally secured to the third member. In the storage orientations the first, second, and third members are substantially parallel, and in the use orientations the second and third members project to opposite sides of the first member.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
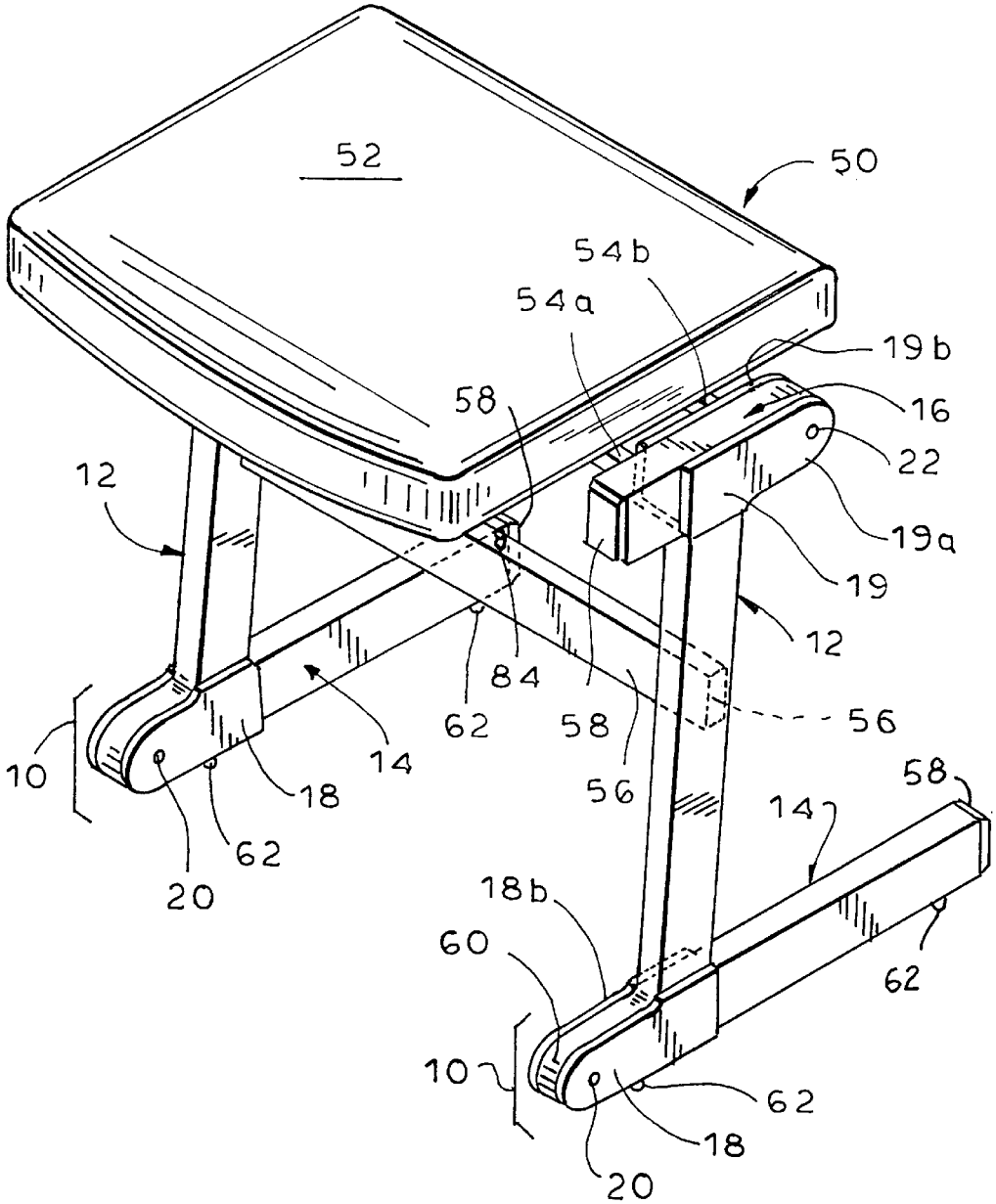
FIG. 1 is an isometric view of a collapsible chair according to the present invention in an erected use orientation.

A "reflex angle" is defined as an angle greater than 180° and less than 360°.

The present invention is illustrated and described hereinbelow in the context of a collapsible chair and a collapsible Z-stand, but, as will be apparent to those skilled in the art, the principles of the present invention are applicable to a wide variety of collapsible structures.

Referring now to the drawing, and in particular to FIGS. 1–5 thereof, therein illustrated is a collapsible structure according to the present invention in the form of a collapsible backless chair, generally designated by the reference numeral 10. The collapsible structure 10 comprises a first longitudinally extending rigid member, generally designated 12, which is generally vertical in both the compact storage orientation and the erected use orientation. A second longitudinally extending rigid member, generally designated 14 is pivotally secured to a bottom end of the first member 12 (but somewhat off axis thereto) and serves as a horizontally extending leg support which rests on the floor in the erected use orientation. A third longitudinally extending rigid member, generally designated 16, is pivotally secured to a top end of the first member 12 (but somewhat off axis thereto) and serves a horizontally-extending seat support or arm in the erected use orientation. It will be appreciated that in the erected use orientation the first, second and third members 12, 14, 16 are disposed in a Z-like orientation relative to one another, with the first member 12 extending generally vertically, and the second and third members 14, 16 extending generally parallel and horizontally in opposite directions from opposite ends of the first member 12. The second member 14 is preferably substantially longer than the third member 16.

The bottom end of first member 12 terminates in a forwardly extending flange bracket 18, while the top end of first member 12 terminates in a rearwardly directed flange bracket 19. The flange brackets 18, 19 extend parallel to one another, but in opposite directions, and are generally transverse, although not necessarily perpendicular, to the longitudinal axis of first member 12. The flange brackets 18, 19 are preferably of unitary, integral, one-piece construction with the first member 12, formed in a single operation therewith, but alternatively may be independently formed from the first member 12 but rigidly, fixedly, securely and permanently attached thereto, as by welding.

The flange brackets 18, 19 are each formed by a pair of laterally spaced parallel plates 18A, 18B and 19A, 19B. The plates 18A, 18B of flange bracket 18 are joined together at the top thereof by the bottom end of the longitudinal portion of first member 12, while the plates 19A, 19B of flange bracket 19 are joined together at the bottom thereof by the top end of the longitudinal portion of first member 12. Thus, as long as the longitudinal portion of the first member 12 is intact, counterclockwise movement of second member 14 is resisted by the bottom end of the longitudinal portion of first member 12 while counterclockwise movement of third member 16 is resisted by the top end of the longitudinal portion of first member 12.

The flange brackets 18, 19 extend substantially transverse to the longitudinal axis of first member 12, but not necessarily at right angles thereto. This is best seen in FIG. 2, where the first member 12 is illustrated in a vertical orientation, as it might be when the collapsible structure is being carried in the compact storage orientation, rather than at an angle to the vertical as illustrated in FIGS. 1 and 3.

Figure 2:
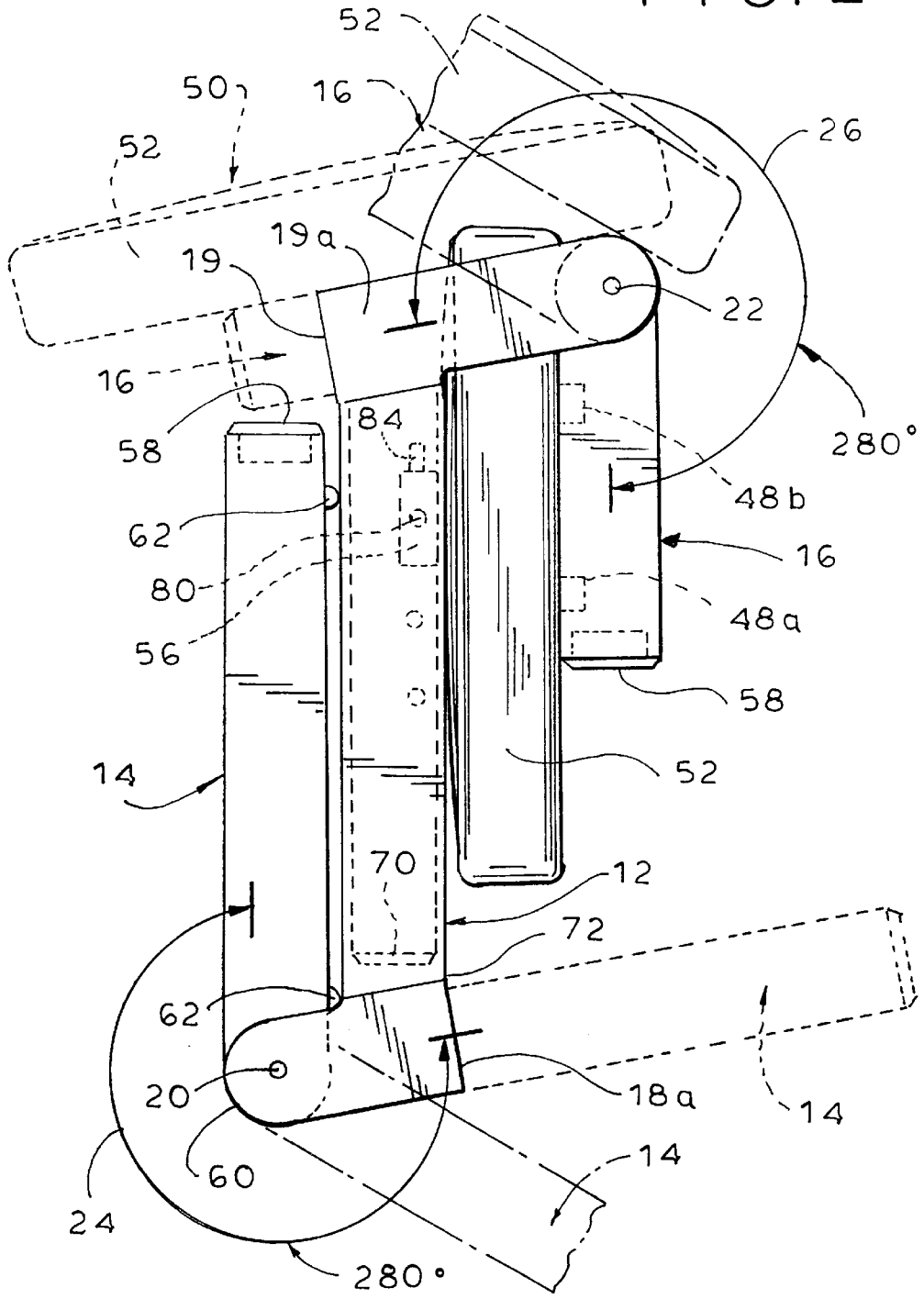
FIG. 2 is a side elevational view thereof in a compact storage orientation, with portions thereof being illustrated in phantom line in partially and fully erected use orientations.
Figure 3:
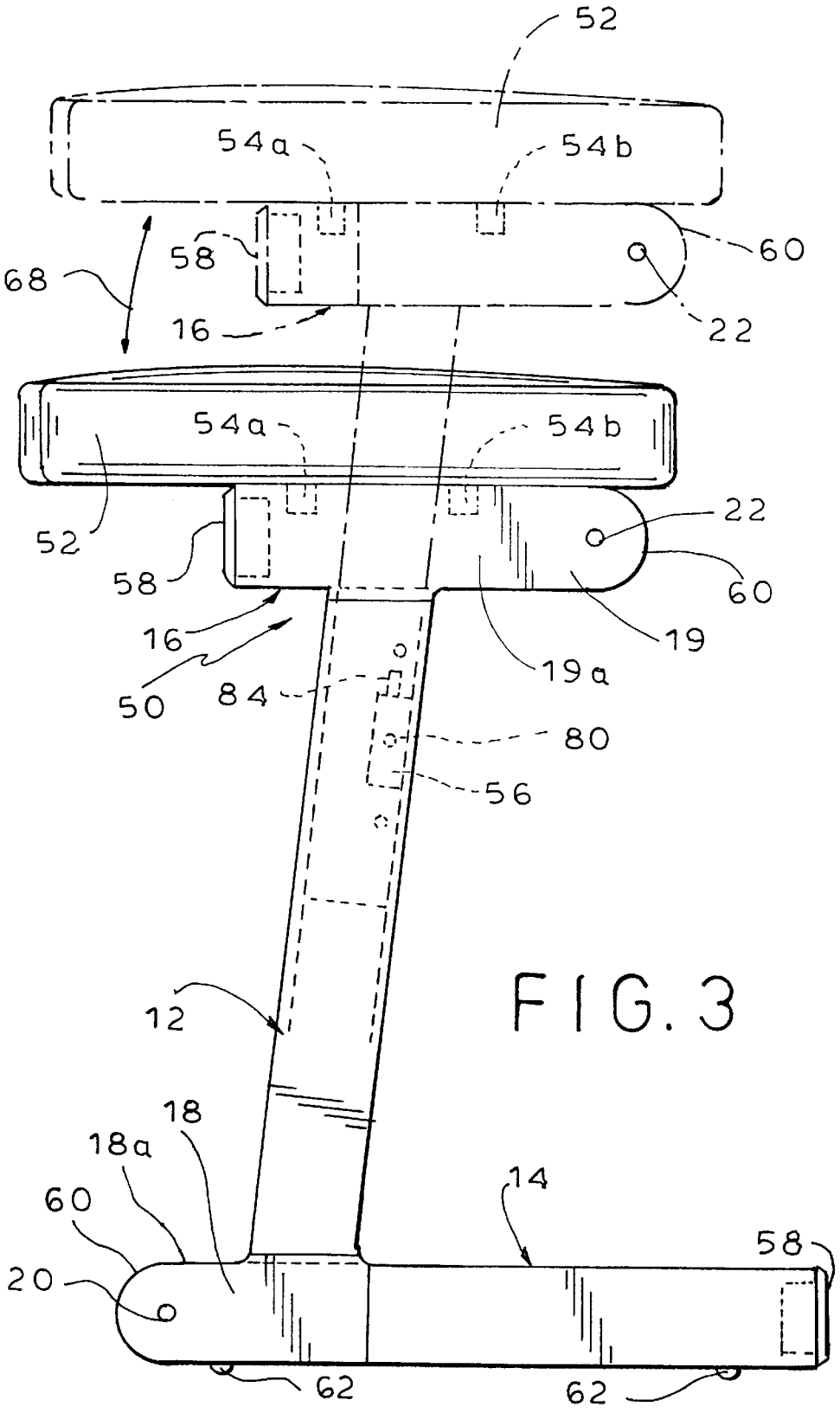
FIG. 3 is a side elevational view thereof in an erected use orientation, with the seat portion being illustrated in solid line in a retracted orientation and in phantom line in an extended orientation.

Adjacent a bottom end of the first member 12, a pivot pin 20 is provided at the free end portion of flange bracket 18 for pivotally connecting the first and second members 12, 14 for movement between a compact storage orientation wherein the first and second members 12, 14 extend longitudinally in a substantially parallel relationship, as illustrated in FIG. 2, and an erected use orientation wherein the first and second members 12, 14 extend longitudinally in a substantially non-parallel and generally transverse relationship, as illustrated in FIG. 1. Similarly, adjacent a top end of the first member 12, a pivot pin 22 is provided at the free end portion of flange bracket 19 for pivotally connecting the first and third members 12, 16 for movement between a compact storage orientation wherein the first and third members 12, 16 extend longitudinally in a substantially parallel relationship, as illustrated in FIG. 2, and an extended use orientation wherein the first and third members 12, 16 extend longitudinally in a substantially non-parallel and generally transverse relationship, as illustrated in FIG. 1.

The pivot means 20, 22 extend through the plates 18A, 18B of flange bracket 18 and plates 19A, 19B of flange bracket 19, respectively, adjacent the free ends thereof—that is, at points well spaced forwardly or rearwardly, respectively, from longitudinal alignment with the longitudinal portion of the first member 12. In the erected use orientation the security afforded by the flange brackets 18, 19 and the abutment of the second and third members 14, 16 against the adjacent ends of the longitudinal portion of the first member 12 far exceeds that which would be obtainable with the pivot points 20, 22 being aligned with the longitudinal axis of the first member 12 and only a releaseable lock mechanism being provided to maintain the second and third members 14, 16 in a fixed relationship with the first member 12.

The double headed arrows 24 (at the bottom of FIG. 2) and 26 (at the top of FIG. 2) illustrate the arc or angle through which the second member 14 and third member 16 must each travel (relative to the first member 12) in moving between the compact storage orientation (illustrated in solid line) and the erected use orientation (illustrated in phantom line). Movement between the compact storage and erected use orientations requires movement of each of the second and third members 14, 16 (relative to the first member 12) through an arc or angle greater than 180° and less than 360°, preferably an arc of about 280° as shown. Such an angle is mathematically defined as a "reflex angle."The movement of the second and third members 14, 16 through less than a reflex angle in passing from the collapsed storage orientation to the erected use orientation would not provide the security afforded by the present invention.

In the compact storage orientation the first, second and third members 12, 14, 16 extend longitudinally in a substantially parallel relationship, as illustrated in FIG. 2; and in the erected use orientation the second and third members 14, 16 extend longitudinally in a substantially parallel relationship, with both the second and third members 14, 16 generally transverse to the first member 12, preferably at 80° thereto. Thus, in the compact storage orientation, the collapsible structure 10 is substantially flat with all rigid members 12, 14, 16 parallel. On the other hand, in the erected use orientation, the collapsible structure 10 has a "Z" configuration with the second and third members 14, 16 extending parallel to one another and being connected together by a first member 12 which is generally vertical, although preferably slightly inclined upwardly and rearwardly.

It will be appreciated by those skilled in the art that movement through the reflex angle may be achieved by movement of the second and third members 14, 16 while the first member 12 is held stationary, by movement of the first member 12 while the second or third members 14 or 16 are held stationary, or by a combination thereof—that is, by movement of the first member 12 and one of the other members 14, 16 so as to effect relative movement through a reflex angle or arc. As illustrated in FIG. 2, the preferred reflex angles used are about 280°.

The members 12, 14, 16 are preferably generally rectangular in cross-section to insure a good fit in the erected use orientation between the top and bottom of the longitudinal portion of first member 12 and the contacting portions of the second and third members 14, 16, respectively.

Figure 4:
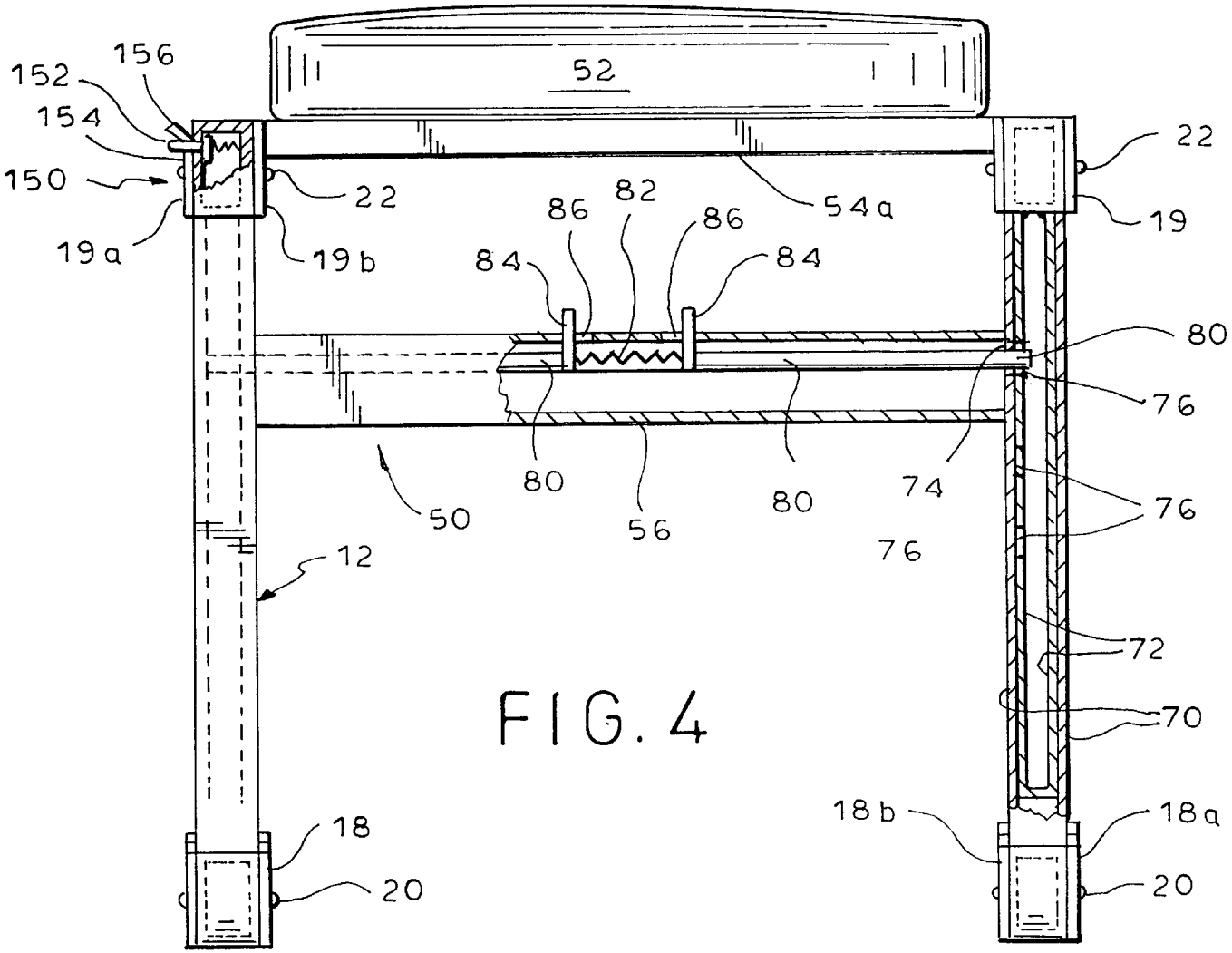
FIG. 4 is a front elevational view thereof in an erected use orientation, with portions thereof being cut away to reveal details of internal construction.
Figure 5:
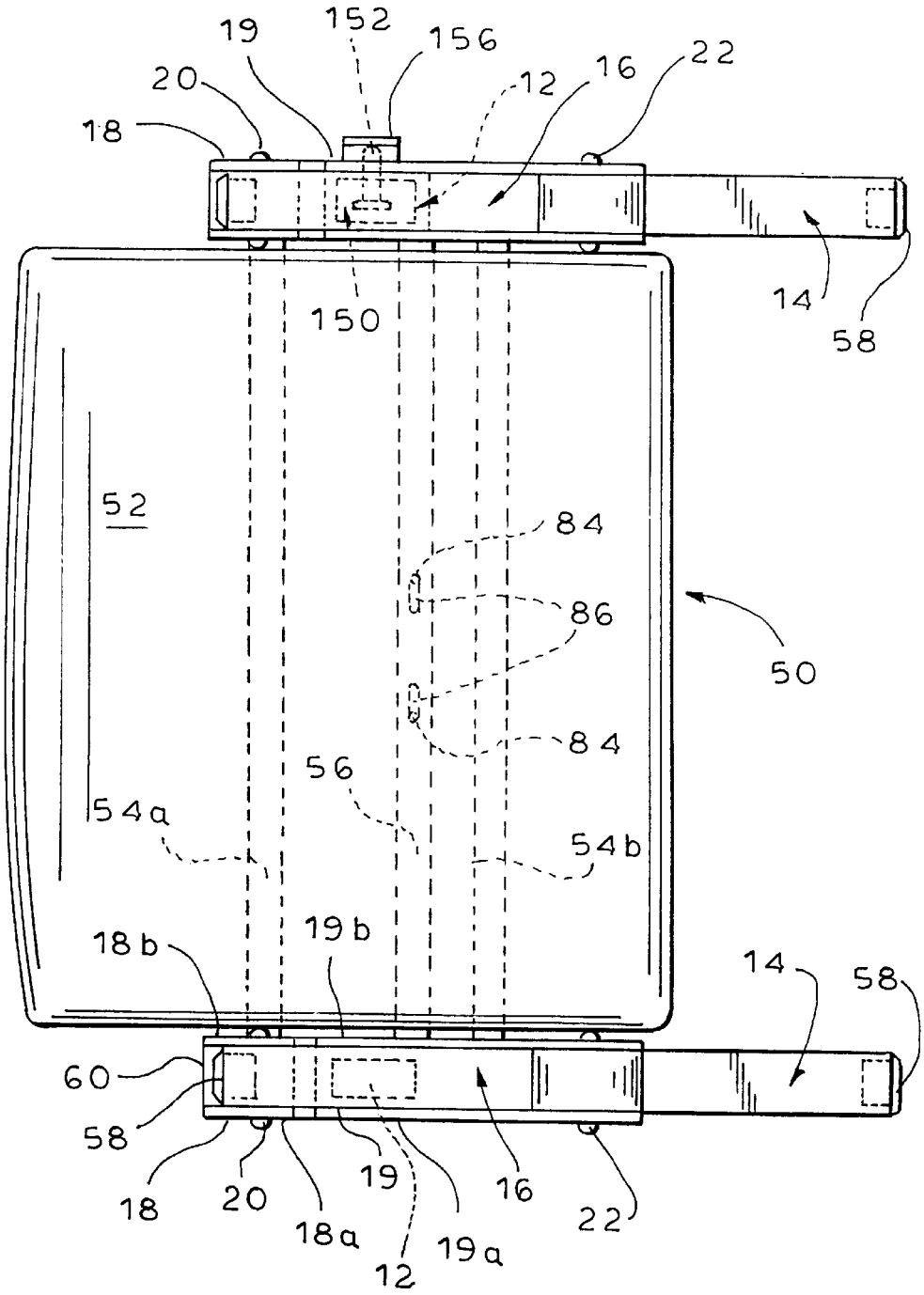
FIG. 5 is a top elevational view thereof in an erected use orientation.

The collapsible backless chair embodiment 50 illustrated in FIGS. 1–5 includes a seat 52 (preferably with a hard cushion) as well as a pair of the collapsible structures 10, one structure 10 adjacent each of the two sides of the seat 52. The collapsible structures 10 are connected by a pair of support bars 54 which connect the third members 16 (as best seen in FIGS. 4 and 5) and support the seat 52. While the front support bar 54A extends forwardly of the flange brackets 19 so as to clear the same during movement between the collapsed storage and erected use orientations, the inner plate 19B of each flange bracket 19 must be provided with a simple cut-out to enable the rear support bar 54B to enter and reside in the brackets 19 as the collapsible structure 10 enters into and remains in the erected use orientation.

For reasons which will become apparent hereinafter, the collapsible structures 10 are further maintained in laterally spaced disposition by the presence of a cross bar 56 connecting the opposed inner surfaces of the first members 12 thereof.

The second and third members 14, 16 are preferably hollow to reduce structure weight and lower material costs, in which case each is preferably provided with a cap 58 at the free end thereof to close the hollow. The member 14, 16 are rounded at the other end 60 thereof (that is, the end adjacent respective pivot pin 20, 22) to follow the curvature of the free ends of the flange bracket plates 18A, 18B and 19A, 19B. The second member 14 preferably has on its undersurface in the erected use orientation a spaced apart pair of bumpers 62 for protection of the floor or the surface on which the chair is used. Optionally, the bumpers 62 may be adjustable in height to compensate for uneven flooring.

Accordingly, the flange bracket 18 and pivot pin 20 therethrough cooperatively form a first connecting means which has one end thereof fixedly secured to the first member 12, extends transverse to the first member 12 in a first direction (that is, forwardly) and has an opposite end thereof pivotably secured to the second member 14. Similarly, the flange bracket 19 and pivot pin 22 therethrough cooperatively form a second connecting means which has one end thereof fixedly secured to the first member 12, extends transverse the first member 12 in an opposed second direction (that is, rearwardly) and has an opposite end pivotally secured to the third member 16. The first connecting means limits movement of the second member 14 through an arc beyond the reflex angle towards the first member 12, and the second connecting means limits movement of the third member 16 through an arc beyond the reflex angle towards the first member 12. Thus, in the erected use orientation, the hollow flange bracket 18 is configured and dimensioned to receive therein a full cross-section of the second member 14 when the second member 14 is at the reflex angle, and the hollow flange bracket 18 is configured and dimensioned to receive therein a full cross-section of the third member 16 when the third member 16 is at the reflex angle. If desired, the flange brackets 18, 19 and their respective pivot pins 20, 22 may be conceptually conceived of as separate from the longitudinal portion of the first member 12 and as forming first and second connecting means, respectively.

It is common for a structure, especially a collapsible structure, to be movable between an extended and a retracted orientation. In the extended orientation the structure is longer or higher than in the retracted orientation. For example, in a collapsible seat, the structure may not only be movable between a compact storage orientation and an erected use orientation, but between extended and retracted orientations. Typically, the collapsible structure is placed in the retracted orientation when it is put in the collapsed storage orientation, thereby to minimize storage space and provide more convenient handling.

Thus the collapsible structures of the present invention are preferably movable in the directions of double-headed arrow 68 between the retracted orientation, illustrated in FIG. 3 in solid line, and the extended orientation, illustrated in FIG. 3 in phantom line. The retraction/extension mechanism is best illustrated in FIG. 4. The first member 12 is composed of an outer telescopic member 70 and an inner telescopic member 72. The outer telescopic member 70 is provided on its inner surface (that is, the surface adjacent to seat 52) with a single aperture 74 therethrough, and the inner telescoping member 72 is provided along its inner surface (that is, the surface adjacent to seat 52) with a vertically spaced plurality of apertures 76 therethrough. The cross bar 56 is hollow, and each half thereof includes a stop 80 which is biased by a spring 82 to extend outwardly through the single aperture 74 of the outer telescoping member 70 and further through an aligned one of the plurality of apertures 76 of the inner telescoping member 72, thereby to preclude telescoping or untelescoping action of the telescoping members 70, 72. On each half of cross bar 56, a pin 84 is secured is secured to the stop 80 for movement therewith and extends upwardly through a slot 86 in the upper surface of support bar 56 to enable manual retraction of the stop 80 from the aperture 76 of the inner telescoping member 72, thereby restoring the possibility of telescopic and untelescopic action between the inner and outer telescoping members 72, 70.

Referring now to the drawing, and in particular to FIGS. 6A–8 thereof, therein illustrated is a collapsible structure according to the present invention in the form of a collapsible Z-stand, generally designated 10'. The Z-stand, generally designated 100, is typically used for supporting at an appropriate level an instrument keyboard, although it may also be used for the support of other instruments and devices requiring a secure non-wobbly support. Except as otherwise specifically designated hereinbelow, the collapsible structure 10' utilized in the collapsible Z-stand 100 is identical to the collapsible structure 10 utilized in the collapsible backless chair 50. Accordingly, elements having the same structure and/or function are designated by the same reference numeral.

The seat 52 and support bars 54 therefor are not present in the Z stand 100.

The Z-stand 100 is of greater dimensions than the chair 50 and thus the structures 10' are of greater dimensions than the structures 10, especially in the length of the rigid members 12, 14, 16. Again because of its greater size, in addition to the cross bar 56 connecting the first members 12 of the laterally spaced collapsible structures 10' in the Z-stand 100, there is also a lower cross bar 102 rigidly connecting the second members 14 and an upper crossbar 104 connecting the third members 16. The cross bars 102, 104 are spaced sufficiently from the pivot pins 20, 22 that they clear the flange brackets 18, 19 and thus do not require the presence of cut-outs in the flange brackets 18, 19 to receive them. As a result, while both second members 14 of chair 50 must be individually moved between the collapsed and use orientations, only one of the two second members 14 of the Z-stand 100 must be moved between such orientations as the other second member 14 is linked thereto by lower cross bar 102 for movement therewith.

Yet again because of its greater size, in the Z-stand 100 a lock plate 110 is preferably affixed to the outer side of first member 12 of one collapsible structure 10'. The locking plate 110 is flat and circular and defines a pair of apertures 112 therethrough. The outer side of each of the second and third members 14, 16 of that same collapsible structure 10' is provided with a single lock pin 114. The lock pins 114 are outwardly biased and manually depressable. They are disposed along the longitudinal lengths of the second and third members 14, 16 such that, when the Z-stand 100 is forcibly moved from the erected use orientation of FIG. 6A into the collapsed storage orientation of FIG. 7, the peripheral (circumferential) edge of lock plate 110 depresses the outwardly biased lock pins 114, which lock pins 114 subsequently return to their outward positions as they enter the apertures 112 of lock plate 110. This mechanism ensures that the second and third members 14, 16 will be maintained in the collapsed storage orientation even as the Z-stand 100 is being transported and stored. On the other hand, when it is desired to return the Z-stand 100 to the erected use orientation of FIG. 6A, the lock pins 114 are manually depressed (e.g., using a finger) through and out of apertures 112 so that the second and third members 14, 16 may be moved away from the lock plate 110 and into the erected use orientation.

Figures 6A, 6B:
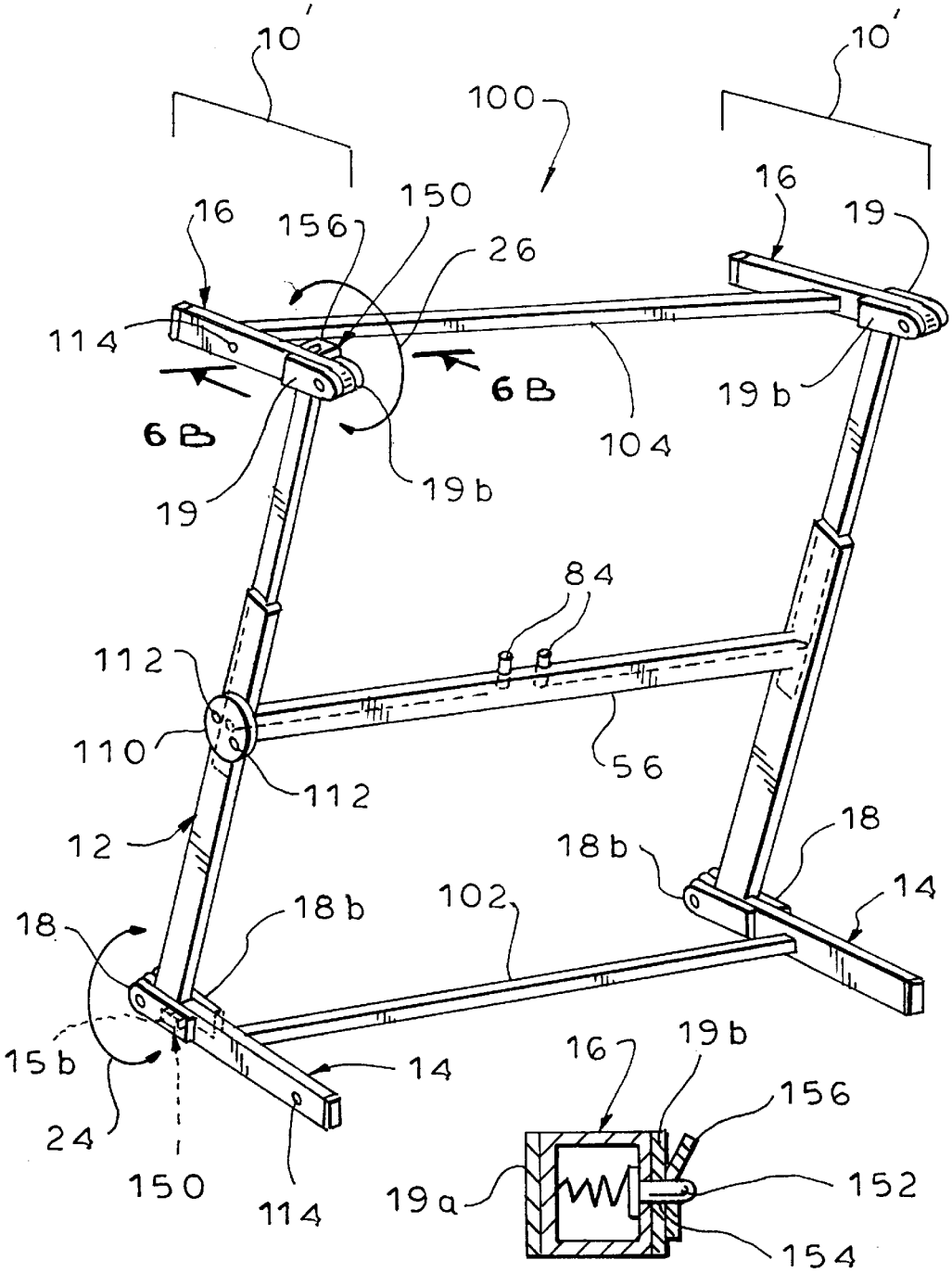
FIG. 6A is an isometric view of a collapsible Z-stand according to the present invention in an erected use orientation.
FIG. 6B is a sectional view thereof taken along the line 6B—6B of FIG. 6A.
Figure 7:
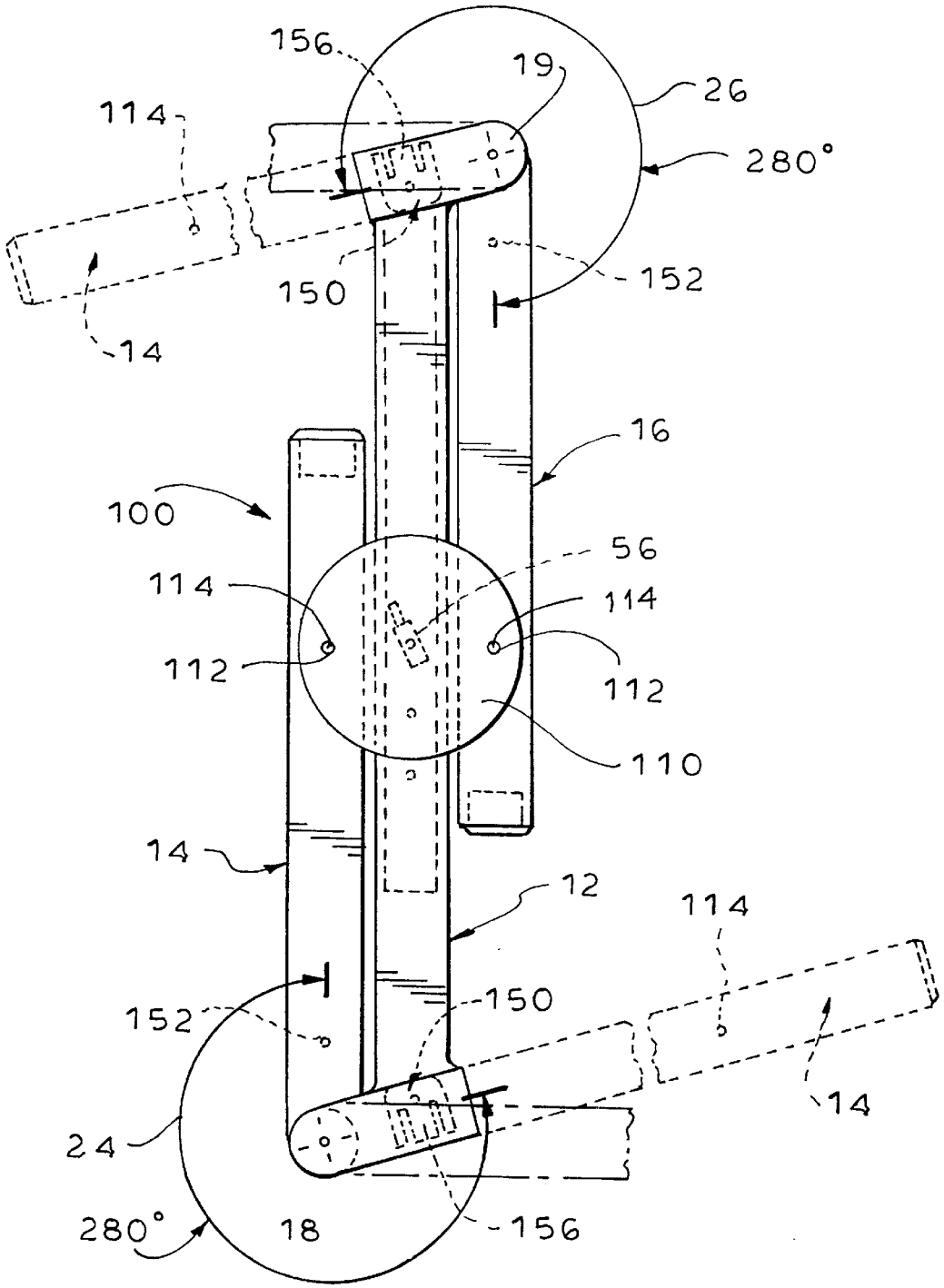
FIG. 7 is a side elevational view thereof in a compact storage orientation, with portions thereof illustrated in phantom line in partially and fully erected use orientations.
Figure 8:
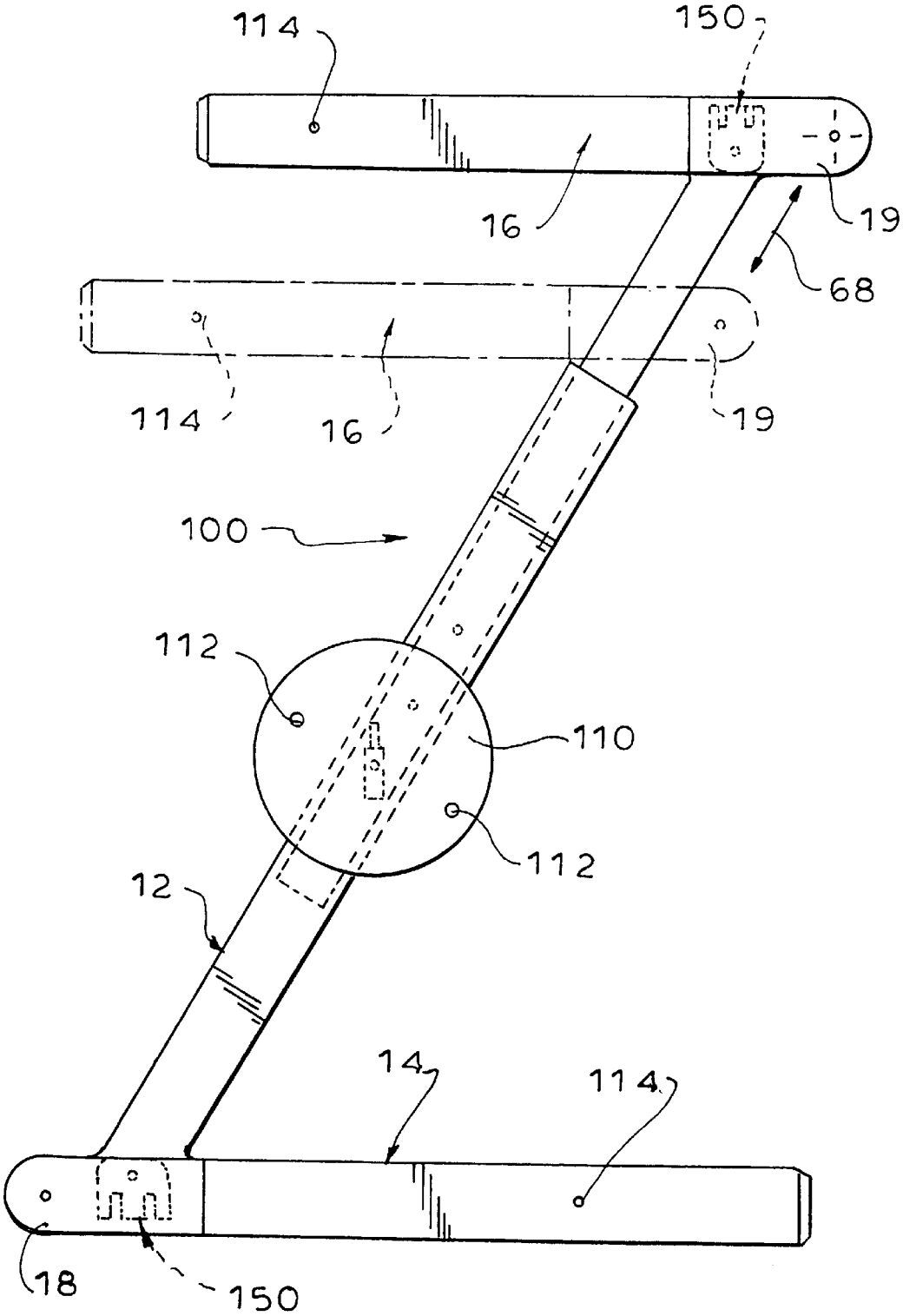
FIG. 8 is a side elevational view thereof in an erected use orientation, with the keyboard support portion being illustrated in solid line in an extended orientation and in phantom line in a retracted orientation.

Referring now in particular to FIGS. 4 and 6A, therein illustrated is a unique feature of the present invention applicable to both the chair 50 and Z-stand 100 embodiments. In the case of the chair embodiment 50, it is desirable to provide a mechanism 150 for locking the seat 52 (and hence the third members 16 of structures 10) in the erected use orientation so that the seat 52 does not accidentally move out of the erected use orientation (wherein it is essentially horizontal) as a result of an unusual distribution of weight on the seat 52 by the user. There is no need for such a locking mechanism 150 to retain the second members 18 of structures 10 in the erected use orientation since the weight of the user on the seat 52 when the chair is in the erected use orientation (with the seat 52 essentially horizontal) prevents the second members 18 from moving out of the erected use orientation. The locking mechanism is required only on one of the two laterally collapsible structures 10 of the chair 50 since both third members 16 are connected for movement as a unit by the support bars 54 under the seat 52.

On the other hand, in the case of the Z-stand embodiment 100, a locking mechanism 150 is desirably provided to maintain both the second and third members 14, 16 in the erected use orientation against displacement therefrom relative to the first member 12. Accordingly, two locking mechanisms 150 are provided for the Z-stand 100, one for the second member 14 and one for the third member 16. This is necessary because the collapsible structures 10' of Z-stand are exposed not only to downward forces (for example, by a person sitting in a chair) but also to horizontal forces tending to pivot the first member 12 (for example, by a person too vigorously playing a keyboard supported by the Z-stand 100). As in the case of the chair 50, the locking mechanisms 150 are required only on one of the two laterally spaced collapsible structures 10' of the Z-stand 100 since both of the second members 14 and both of the third members 16 are separately connected for movement as a unit by the respective cross bars 102, 104.

The locking mechanism 150 comprises a locking button 152 on the third member 16 of one structure 10 (in the chair embodiment 50) and on each of the second and third members 14, 16 of one structure 10' (in the Z-stand 100). The locking button 152 is manually depressable and biased to extend outwardly from its rigid member 16 or 14, 16. In the chair 50, an aperture 154 in the flange bracket 19 of the first member 12 of structure 10 is configured and dimensioned to receive a portion of the locking button 152 of third member 16 therethrough when the collapsible structure 10 is in the erected use orientation. More particularly, the aperture 154 is disposed in the inner plate 19B of flange bracket 19 of first member 12 of the collapsible structure 10. In the Z-stand 100, apertures 154 in the flange brackets 18, 19 adjacent the two ends of the first member 12 of structure 10' are configured and dimensioned to each receive a respective portion of the locking buttons 152 of the second and third members 14, 16 therethrough when the collapsible structure 10' is in the erected use orientation. More particularly, the apertures 154 are disposed in the outer plates 18A, 19A of hinge brackets 18, 19 of first member 12 of the collapsible structure 10'.

The novel feature of the present invention is that, in addition to the locking mechanism 150 comprising the locking button 152 and aperture 154, a camming ledge 156 is provided for each locking mechanism 150. For chair 50, the camming ledge 156 extends in an outward direction from the first member 12 (and more particularly the general plane of the outer plate 19A) of the first member 12 and above the aperture 154. For Z-stand 100, the camming ledges 156 extend in an inward direction from the first members 12 (and more particularly the general plane of the inner plates 18B, 19B) of the first member 12 and above the apertures 154. The camming ledge 156 automatically temporarily depresses the locking button 152—that is, it causes the locking button 152 to retreat into the third member 16 (or second and third members 14, 16) as the member 16 or 14, 16 containing the locking button 152 moves from the storage orientation to the use orientation. The camming ledge 156 also limits accidental depression of its respective locking button 152 when the member 16 or 14, 16 containing the locking button 152 is in the use orientation and the locking button 152 extends outwardly from the first member 12 (through the aperture 154) below the ledge 156, while still permitting intentional manual forcible depression of its respective locking button 152 through and out of the aperture 154, thereby to enable movement of the member 16 or 14, 16 containing the locking button 152 from the use orientation to the storage orientation.

To provide protection against accidental depression of its respective button 152, the ledge 156 extends outwardly from the first member 12 (that is, from the outer plate 18A of chair 50 or inner plate 18B, 19B of Z-stand 100) at least as far as the portion of the locking button 152 extending outwardly from the first member 12. Preferably the ledge 156 is disposed closely adjacent the outwardly extending button portion, thereby to facilitate blind or purely tactile location of the button 152. The ledge 156 extends upwardly and outwardly, and is conveniently formed of a turned-out edge portion of the first member (that is, the outer plate 18A or inner plate 18B, 19B).

Thus the locking mechanism 150 and camming ledge 156 are similar in the chair 50 and Z-stand 100 except that in the Z-stand 100 the camming ledge 156 extends in an inward direction from respective inner plates 18B, 19B of one collapsible structure 10' and the buttons 152 project in an inward direction through apertures 154 in the respective inner plates 18B, 19B. The reversal in direction of the buttons 152 and ledges 156 in the Z-stand 100 presents a smoother outer appearance to the Z-stand 100 and is possible because in the erected use orientation the relatively open nature of the Z-stand 100 (relative to chair 50) permits easy access to the buttons 152. Clearly, the direction of extension of the buttons 152 and ledges 156 and the disposition of the apertures 154 may be varied depending upon the particular applications involved.

To summarize, the present invention provides a collapsible structure affording a very high degree of security when it is in the erected use orientation. In one preferred embodiment, the structure automatically locks in the erected use orientation with the lock being protected against unintended release. In another preferred embodiment, the structure combines a high level of security in the erected use orientation and protection against accidental release of the locking system. The structure of the present invention is simple and inexpensive to construct, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A collapsible structure comprising:

(A) first and second longitudinally extending rigid members; and (B) means pivotally connecting said first and second members for movement between a compact storage orientation wherein said first and second members extend longitudinally in a substantially parallel relationship and an erected use orientation wherein said first and second members extend longitudinally in a substantially non-parallel relationship, said movement between said storage and use orientations requiring movement of said second member through an arc greater than 180° and less than 360° into a reflex angle relative to said first member.

2. A collapsible structure comprising:

(A) first and second longitudinally extending rigid members; and (B) means pivotally connecting said first and second members for movement between a compact storage orientation wherein said first and second members extend longitudinally in a substantially parallel relationship and an erected use orientation wherein said first and second members extend longitudinally in a substantially non-parallel relationship, said movement between said storage and use orientations requiring movement of said second member through an arc greater than 180° and less than 360° into a reflex angle relative to said first member;

said connecting means having one end thereof fixedly secured to said first member, extending transverse to said first member, and having an opposite end thereof pivotally secured to said second member.

3. The structure of claim 2 wherein said connecting means limits movement of said second member through said arc beyond the reflex angle relative to said first member.

4. The structure of claim 1 wherein said connecting means limits movement of said second member through said arc beyond the reflex angle relative to said first member.

5. The structure of claim 1 wherein said connecting means is configured and dimensioned to receive therein a full cross-section of said second member aligned with said first member when said second member is at the reflex angle.

6. A collapsible structure comprising:

(C) first and second longitudinally extending rigid members; and (D) means pivotally connecting said first and second members for movement between a compact storage orientation wherein said first and second members extend longitudinally in a substantially parallel relationship and an erected use orientation wherein said first and second members extend longitudinally in a substantially non-parallel relationship, said movement between said storage and use orientations requiring movement of said second member through an arc greater than 180° and less than 360° into a reflex angle relative to said first member;

(E) locking means including a depressable locking button on said second member biased to extend outwardly therefrom, and an aperture in said first member configured and dimensioned to receive at least a portion of said button; and (F) a camming ledge extending outwardly from said first member and above said aperture both (i) for automatically temporarily depressing said button as said second member moves from said storage orientation into said use orientation, and (ii) for limiting accidental depression of said button when said second member is in said use orientation and said button extends outwardly from said first member below said ledge, while still permitting intentional manual forcible depression of said button out of said aperture, thereby to enable movement of said second member from said use orientation to said storage orientation.

7. A collapsible structure comprising:

(A) first and second longitudinally extending rigid members; and (B) means pivotally connecting said first and second members for movement between a compact storage orientation wherein said first and second members extend longitudinally in a substantially parallel relationship and an erected use orientation wherein said first and second members extend longitudinally in a substantially non-parallel relationship, said movement between said storage and use orientations requiring movement of said second member through an arc greater than 180° and less than 360° into a reflex angle relative to said first member;

said connecting means having one end thereof fixedly secured to said first member, extending transverse to said first member, and having an opposite end thereof pivotally secured to said second member;

said connecting means limiting movement of said second member through said arc beyond the reflex angle relative to said first member; and said connecting means being configured and dimensioned to receive therein a full cross-section of said second member when said second member is at the reflex angle.

8. A collapsible structure comprising:

(A) first and second longitudinally extending rigid members; and (B) means pivotally connecting said first and second members for movement between a compact storage orientation wherein said first and second members extend longitudinally in a substantially parallel relationship and an erected use orientation wherein said first and second members extend longitudinally in a substantially non-parallel relationship, said movement between said storage and use orientations requiring movement of said second member through an arc greater than 180° and less than 360° into a reflex angle relative to said first member;

said connecting means having one end thereof fixedly secured to said first member, extending transverse to said first member, and having an opposite end thereof pivotally secured to said second member;

said connecting means limiting movement of said second member through said arc beyond the reflex angle relative to said first member;

said connecting means being configured and dimensioned to receive therein a full cross-section of said second member when said second member is at the reflex angle;

(C) locking means including a depressable locking button on said second member biased to extend outwardly therefrom, and an aperture in said first member configured and dimensioned to receive at least a portion of said button; and (D) a camming ledge extending outwardly from said first member and above said aperture both (i) for automatically temporarily depressing said button as said second member moves from said storage orientation into said use orientation, and (ii) for limiting accidental depression of said button when said second member is in said use orientation and said button extends outwardly from said first member below said ledge, while still permitting intentional manual forcible depression of said button out of said aperture, thereby to enable movement of said second member from said use orientation to said storage orientation.

9. A collapsible structure comprising:

(A) first and second longitudinally extending rigid members;

(B) means pivotally connecting said first and second members for movement between a compact storage orientation wherein said first and second members extend longitudinally in a substantially parallel relationship and an erected use orientation wherein said first and second members extend longitudinally in a substantially non-parallel relationship;

(C) locking means including a depressable locking button on said second member biased to extend outwardly therefrom, and an aperture in said first member configured and dimensioned to receive at least a portion of said button; and (D) a camming ledge extending outwardly from said first member and above said aperture both (i) for automatically temporarily depressing said button as said second member moves from said storage orientation into said use orientation, and (ii) for limiting accidental depression of said button when said second member is in said use orientation and said button extends outwardly from said first member below said ledge, while still permitting intentional manual forcible depression of said button out of said aperture, thereby to enable movement of said second member from said use orientation to said storage orientation.

10. The structure of claim 9 wherein said ledge extends outwardly from said first member at least as far as the portion of said button extending outwardly from said first member.

11. The structure of claim 10 wherein said ledge is disposed closely adjacent said button portion.

12. The structure of claim 9 wherein said ledge extends upwardly and outwardly.

13. The structure of claim 9 wherein said ledge is a turned-out edge portion of said first member.

14. A collapsible structure comprising:

(A) first, second and third longitudinally extending rigid members;

(B) adjacent one end of said first member, first means pivotally connecting said first and second members for movement between a compact storage orientation wherein said first and second members extend longitudinally in a substantially parallel relationship and an erected use orientation wherein said first and second members extend longitudinally in a substantially non-parallel relationship, said movement between said storage and use orientations requiring movement of said second member through an arc greater than 180° and less than 360° into a reflex angle relative to said first member; and (C) adjacent an opposite end of said first member, second means pivotally connecting said third and first members for movement between a compact storage orientation wherein said third and first members extend longitudinally in a substantially parallel relationship and an erected use orientation wherein said third and first members extend longitudinally in a substantially non-parallel relationship, said movement between said storage and use orientations requiring movement of said third member through an arc greater than 180° and less than 360° into a reflex angle relative to said first member.

15. The system of claim 14 wherein said first connecting means has one end thereof fixedly secured to said first member, extends transverse to said first member in a first direction, and has an opposite end thereof pivotally secured to said second member; and wherein said second connecting means has one end thereof fixedly secured to said first member, extends transverse to said first member in an opposed second direction, and has an opposite end thereof pivotally secured to said third member.

16. The structure of claim 14 wherein said first connecting means limits movement of said second member through said arc beyond the reflex angle relative to said first member; and said second connecting means limits movement of said third member through said arc beyond the reflex angle relative to said first member.

17. The structure of claim 14 wherein said first connecting means is configured and dimensioned to receive therein a full cross-section of said second member when said second member is at the reflex angle, and said second connecting means is configured and dimensioned to receive therein a full cross-section of said third member when said third member is at the reflex angle.

18. The collapsible structure of claim 14 wherein in said storage orientations said first, second, and third members are substantially parallel, and in said use orientations said second and third members project to opposite sides of said first member.

* * * * *